US008046217B2

(12) United States Patent
Miyasaka et al.

(10) Patent No.: US 8,046,217 B2
(45) Date of Patent: Oct. 25, 2011

(54) GEOMETRIC CALCULATION OF ABSOLUTE PHASES FOR PARAMETRIC STEREO DECODING

(75) Inventors: Shuji Miyasaka, Osaka (JP); Yoshiaki Takagi, Kanagawa (JP); Naoya Tanaka, Osaka (JP); Mineo Tsushima, Nara (JP)

(73) Assignee: Panasonic Corporation, Osaka (JP)

( * ) Notice: Subject to any disclaimer, the term of this patent is extended or adjusted under 35 U.S.C. 154(b) by 938 days.

(21) Appl. No.: 11/660,094

(22) PCT Filed: Aug. 2, 2005

(86) PCT No.: PCT/JP2005/014128

§ 371 (c)(1),
(2), (4) Date: Feb. 13, 2007

(87) PCT Pub. No.: WO2006/022124

PCT Pub. Date: Mar. 2, 2006

(65) Prior Publication Data

US 2007/0255572 A1 Nov. 1, 2007

(30) Foreign Application Priority Data

Aug. 27, 2004 (JP) ..... 2004-248989
Apr. 6, 2005 (JP) ..... 2005-110192

(51) Int. Cl.
*G10L 19/14* (2006.01)
*G10L 19/00* (2006.01)
*G10L 19/02* (2006.01)

(52) U.S. Cl. .. 704/225; 704/201; 704/204; 704/E19.005

(58) Field of Classification Search ..... None
See application file for complete search history.

(56) References Cited

U.S. PATENT DOCUMENTS 5,414,796 A * 5/1995 Jacobs et al. ..... 704/221
(Continued)

FOREIGN PATENT DOCUMENTS

EP 0 546 806 6/1993
(Continued)

OTHER PUBLICATIONS

Faller et al. ("Binaural Cue Coding—Part II: Schemes and Applications". IEEE Transactions on Speech and Audio Processing, vol. 11 No. 6, Nov. 2003).*

(Continued)

*Primary Examiner* — Talivaldis Ivars Smits
*Assistant Examiner* — Jesse Pullias
(74) *Attorney, Agent, or Firm* — Wenderoth Lind & Ponack, L.L.P.

(57) ABSTRACT

An audio decoder which reproduces original signals from a bit stream including (i) a downmix signal of the original signals, and (ii) supplementary information indicating a gain ratio D and phase difference θ between the original signals. The audio decoder includes: a decoding unit extracting the downmix signal; a transformation unit transforming the extracted downmix signal into a frequency domain signal; a phase rotator determination unit determining two phase rotators having, as the phase rotation angles, angles α and β respectively obtained by dividing a contained angle by a diagonal of a parallelogram; a separation unit separating the frequency domain signal into two separation signals respectively indicating angles α and β as phase differences between the signals and the decoded downmix signal; and an inverse transformation unit inversely transforming the respective two separation signals into time domain signals so as to reproduce the two audio signals.

17 Claims, 9 Drawing Sheets

U.S. PATENT DOCUMENTS

| | | | | |
|---|---|---|---|---|
| 5,463,424 | A | 10/1995 | Dressler | |
| 5,602,874 | A | 2/1997 | Luz et al. | |
| 5,671,287 | A * | 9/1997 | Gerzon | 381/17 |
| 5,724,429 | A * | 3/1998 | Banerjea | 381/1 |
| 5,854,813 | A | 12/1998 | Rottinghaus et al. | |
| 6,009,130 | A | 12/1999 | Lurey et al. | |
| 6,167,161 | A * | 12/2000 | Oami | 382/250 |
| 6,539,357 | B1 | 3/2003 | Sinha | |
| 7,039,204 | B2 | 5/2006 | Baumgarte | |
| 7,627,480 | B2 * | 12/2009 | Ojanpera | 704/500 |
| 7,630,500 | B1 * | 12/2009 | Beckman et al. | 381/18 |
| 7,933,415 | B2 | 4/2011 | Breebaart | |
| 2003/0235317 | A1 | 12/2003 | Baumgarte | |
| 2003/0236583 | A1 | 12/2003 | Baumgarte et al. | |
| 2005/0254446 | A1 | 11/2005 | Breebaart | |

FOREIGN PATENT DOCUMENTS

| | | |
|---|---|---|
| EP | 1 376 538 | 1/2004 |
| EP | 1 377 123 | 1/2004 |
| JP | 6-021857 | 1/1994 |
| JP | 9-501286 | 2/1997 |
| JP | 2827777 | 9/1998 |
| JP | 10-512114 | 11/1998 |
| JP | 2827777 | 11/1998 |
| JP | 2001-209399 | 8/2001 |
| JP | 2004-048741 | 2/2004 |
| JP | 2004-078183 | 3/2004 |
| JP | 2005-523624 | 8/2005 |
| WO | 95/04442 | 2/1995 |
| WO | 96/21305 | 7/1996 |
| WO | 03/090206 | 10/2003 |
| WO | 03/090208 | 10/2003 |

OTHER PUBLICATIONS

Faller et al. ("Binaural Cue Coding Applied to Stereo and Multi-Channel Audio Compression". AES 112th Convention, Munich, Germany, May 2002).*

Schuijers et al. ("Advances in Parametric Coding for High-Quality Audio". AES 114th Convention, Mar. 2003).* http://en.wikipedia.org/wiki/Law_of_cosines accessed Mar. 6, 2004.*

M. Bosi et al., "ISO/IEC 13818-7 (MPEG2 Advanced Audio Coding, AAC)", International Organization for Standardization ISO/IEC JTC1/SC29/WG11 Coding of Moving Pictures and Audio, pp. 1-74, Apr. 1997.

Faller et al., "Efficient Representation of Spatial Audio Using Perceptual Parametrization", Applications of Signal Processing to Audio and Acoustics 2001, IEEE Workshop, Oct. 2001, pp. 199-202.

* cited by examiner

FIG. 3

| Starting frequency (kHz) | Gain ratio information number | Phase difference information number | Phase polarity information number |
|---|---|---|---|
| 0.000000 | 0 | 0 | 0 |
| 0.086133 | 1 | 1 | 1 |
| 0.172266 | 2 | 2 | 2 |
| 0.258398 | 3 | 3 | 3 |
| 0.344531 | 4 | 4 | 4 |
| 0.430664 | 5 | 5 | 5 |
| 0.516797 | 6 | 6 | 6 |
| 0.602930 | 7 | 7 | 7 |
| 0.689062 | 8 | 8 | 8 |
| 0.775195 | 9 | 9 | 9 |
| 0.861328 | 10 | 10 | 10 |
| 1.033594 | 11 | 11 | — |
| 1.378125 | 12 | 12 | |
| 1.722656 | 13 | 13 | |
| 2.067188 | 14 | 14 | |
| 3.100781 | 15 | 15 | |
| 4.651172 | 16 | 16 | |
| 6.890625 | 17 | | |
| 9.646875 | 18 | 17 | |
| 12.403125 | 19 | | |
| 15.159375 | 20 | 18 | |
| 17.915625 | 21 | | |

FIG. 8

| Quantization threshold | Code length | Huffman code |
|---|---|---|
| -1.000 | 9 | 101010110 |
| -0.969 | 9 | 101010111 |
| -0.949 | 9 | 101010101 |
| -0.929 | 5 | 10100 |
| -0.700 | 3 | 100 |
| -0.300 | 2 | 10 |
| 0.300 | 2 | 11 |
| 0.700 | 4 | 1011 |
| 0.880 | 6 | 101011 |
| 0.950 | 7 | 1010100 |
| 0.990 | 9 | 101010100 |
| 1.000 | | |

FIG. 9

| Quantization threshold | Code length | Huffman code |
|---|---|---|
| -1.000 | 9 | 101010110 |
| -0.969 | 9 | 101010111 |
| -0.949 | 9 | 101010101 |
| -0.929 | 5 | 10100 |
| -0.720 | 3 | 100 |
| -0.350 | 2 | 10 |
| 0.350 | 2 | 11 |
| 0.720 | 4 | 1011 |
| 0.880 | 6 | 101011 |
| 0.950 | 7 | 1010100 |
| 0.990 | 9 | 101010100 |
| 1.000 | | |

GEOMETRIC CALCULATION OF ABSOLUTE PHASES FOR PARAMETRIC STEREO DECODING

BACKGROUND OF THE INVENTION

1. Field of Invention

The present invention relates to a decoder which decodes original signals from supplementary information indicating the relationship between the original signals and a downmix signal obtained by downmixing the original signals, and in particular relates to a technique for decoding original signals with high accuracy in the case where supplementary information indicates the phase difference and the gain ratio of the original signals.

2. Description of the Related Art

Recently, a technique known as Spatial Codec (spatial coding) has been developed. This technique aims at compressing and coding realistic sounds from multiple channels using a very small amount of information. For example, the AAC format, which is a multi-channel codec widely used as an audio format for digital television, requires a bit rate of 512 kbps or 384 kbps per 5.1 channels. However, Spatial Codec aims at compressing and coding multi-channel signals using a very small bit rate of 128 kbps, 64 kbps or 48 kbps.

As a technique to realize this, Patent Reference 1, for example, discloses that it is possible to compress and code realistic sounds using a small amount of information by coding the phase difference and the gain ratio of channels.

On the other hand, some compression schemes which have been widely used partially employ such a technique of coding the phase difference and the gain ratio of channels. For example, the above-mentioned AAC format (ISO/IEC 13818-7) employs a technique known as Intensity Stereo.

Patent Reference 1: U.S. Patent Publication No. UP2003/0236583A1.

BRIEF SUMMARY OF INVENTION

Problems that Invention is to Solve

Patent Reference 1 discloses coding the phase difference and the gain ratio of channels. However, it does not disclose a specific decoding process in which a downmix signal can be separated into original multi-channel signals based on such information. In particular, it does not disclose a technique in which the orientation information of the phase difference is handled.

In addition, Intensity Stereo in the AAC standard (ISO/IEC 13818-7) in the MPEG schemes discloses quantizing phase differences on a per frequency band basis with an accuracy obtained by a two-value quantization. In this case, the orientation information of the phase difference is not needed, but only the phase differences of 0 degree and 180 degrees can be indicated, resulting in a deterioration in sound quality.

The present invention has been conceived considering the conventional problems like this, and aims at providing an audio decoder which is capable of reproducing original signals accurately from the downmix signal of the original signals and information obtained by quantizing the phase difference and the gain ratio information of channels on a per frequency band basis.

Means to Solve the Problems

In order to solve the above-described problems, the audio decoder of the present invention decodes a bitstream and reproduces two audio signals. The bitstream includes first coded data indicating a downmix signal obtained by downmixing the two audio signals. Second coded data indicates a gain ratio D between the two audio signals, and third coded data indicates a phase difference θ between the two audio signals. The audio decoder includes: a decoding unit which decodes the first coded data into the downmix signal; a transformation unit which transforms the downmix signal generated by the decoding unit into a frequency domain signal; a determination unit which determines two phase rotators which respectively form a phase rotation angle α and a phase rotation angle β which are obtained by diagonally dividing a contained angle formed by two adjacent sides in a parallelogram where a length ratio between the sides is equal to the gain ratio D indicated in the second coded data, and also, the contained angle is equal to the phase difference θ indicated in the third coded data; a separation unit which separates, using the two phase rotators and the gain ratio D which is indicated in the second coded data, the frequency domain signal into two separation signals which respectively indicates a phase difference θ and a phase difference θ with respect to the downmix signal; and an inverse transformation unit which inversely transforms the respective two separation signals into time domain signals so as to reproduce the two audio signals.

With this structure, an absolute phase, which is indicated by angles α and β, of the two audio signals based on the downmix signal is reproduced. Thus, the accuracy in reproducing the signals is improved compared with that in the conventional art where only the relative phase difference θ between the two audio signals is reproduced.

In addition, the determination unit may determine, as the phase rotators, either two complex numbers $e^{-j\alpha}$ and $e^{j\beta}$ or conjugate complex numbers $e^{j\alpha}$ and $e^{-j\beta}$ of the complex numbers $e^{-j\alpha}$ and $e^{j\beta}$, and the separation unit may generate the two separation signals by multiplying, with the frequency domain signal generated by the transformation unit, the respective complex numbers determined as the phase rotators.

In addition, the bitstream may further include fourth coded data representing phase polarity information S which indicates which phase of the two audio signals is ahead of the other, and the separation unit may generate the two separation signals by multiplying, with the frequency domain signal generated by the transformation unit, either the determined two complex numbers or conjugate complex numbers associated with the phase polarity information S indicated as the fourth coded data.

With this structure, it becomes possible to accurately provide a phase difference for obtaining separation signals in the frequency domain. In particular, the implementation of phase polarity information S makes it possible to accurately reproduce an advancement or a delay of the phase of the two audio signals.

In addition, the determination unit may obtain the angles α and β using the following equations:

$$\alpha=\arccos((1+D\cos\theta)/((1+D^2+2D\cos\theta)^{0.5}))\text{; and}$$

$$\beta=\arccos((D+\cos\theta)/((1+D^2+2D\cos\theta)^{0.5}))\text{, and}$$

may determine the two phase rotators using the obtained α and β.

Additionally, the determination unit may obtain cos α associated with the angle α, and obtain cos β associated with the angle β, using the following equations:

$$\cos\alpha=(1+D\cos\theta)/((1+D^2+2D\cos\theta)^{0.5})\text{; and}$$

$$\cos\beta=(D+\cos\theta)/((1+D^2+2D\cos\theta)^{0.5})\text{, and}$$

may determine the two phase rotators using the obtained cos α and cos β.

With this structure, the absolute phase of the two audio signals with respect to the downmix signal is reproduced geometrically and precisely. In general, it is considered that a phase rotator is indicated not directly using a phase rotation angle but using trigonometric functions of the phase rotation angle. Thus, with the latter structure, it becomes possible to efficiently determine a phase rotator without performing an arccos operation which requires a large amount of calculation.

In addition, the third coded data may indicate a phase difference θ between the two audio signals, using a value of cos θ within a range from 0 to 180 degrees, and the determination unit may determine the two phase rotators, using the value of cos θ indicated in the third coded data.

This structure eliminates the necessity of calculating cos θ, and makes it possible to efficiently determine a phase rotator.

In addition, the determination unit may (a) have a table which holds function values expressed using at least trigonometric functions of phase differences and associated with phase differences respectively and (b) determine the phase rotators with reference to a function value, in the table, associated with the phase difference θ indicated in the third coded data. In addition, the table may hold values of sin θ and cos θ, which are associated with the respective phase differences θ. Additionally, it is preferable that the value of sin θ and the value of cos θ associated with the same phase difference θ may be stored in an adjacent area.

With this structure, it is possible to eliminate at least the processing of trigonometric functions at the time of determining the phase rotator. Further, storing the value of sin θ and the value of cos θ in an adjacent area makes it possible to efficiently obtain function values.

In addition, the table may hold the following four function values associated with each of combinations made up of a gain ratio D and a phase difference θ:

$$W(D,\theta)=(1+D\cos\theta)/((1+D^2+2D\cos\theta)^{0.5});$$

$$X(D,\theta)=(D\sin\theta)/((1+D^2+2D\cos\theta)^{0.5});$$

$$Y(D,\theta)=(D+\cos\theta)/((1+D^2+2D\cos\theta)^{0.5});\text{ and}$$

$$Z(D,\theta)=\sin\theta/((1+D^2+2D\cos\theta)^{0.5}),\text{ and}$$

the determination unit may determine the phase rotators with reference to the four function values, in the table, associated with one of the combinations which is made up of the gain ratio D indicated in the second coded data and the phase difference θ indicated in the third coded data. Additionally, it is preferable that the four function values, associated with each of combinations of the same gain ratio D and phase difference θ may be stored in an adjacent area. In addition, the table may hold, in adjacent areas, the four function values which are associated with the one of the combinations made up of the same gain ratio D and the same phase difference θ.

With this structure, it becomes possible to obtain all the values necessary to determine a phase rotator by referring to a reference table. In particular, storing the four function values associated with each of the combinations of the same gain ratio D and phase difference θ in an adjacent area makes it possible to efficiently obtain function values.

In addition, the table may hold corrected values obtained by further correcting the four function values according to the gain ratio D.

With this structure, it becomes possible to add an effect of precisely reproducing the earlier mentioned signal phase to a surround-sound effect by adding a mount of reverberation associated with the phase rotator so as to separate signals.

In addition, the bitstream may include the following for respective frequency bands: second coded data indicating a gain ratio D in the frequency band of the two audio signals; and the third coded data indicating a phase difference θ. The transformation unit may transform the downmix signal into a frequency domain signal for the respective frequency bands. The determination unit may determine, for the respective frequency bands, two phase rotators forming a phase rotation angle α and a phase rotation angle β, which are obtained by diagonally dividing a contained angle formed by two adjacent sides in a parallelogram where: a length ratio between the sides is equal to the gain ratio D indicated in the second coded data; and the contained angle is equal to the phase difference θ indicated in the third coded data. The separation unit may generate, for the respective frequency bands, two separation signals based on the frequency domain signal, using the determined two phase rotators and the gain ratio D. The inverse transformation unit may inversely transform the respective two separation signals into time domain signals for the respective frequency bands, and may reproduce the two audio signals based on the time domain signals which are obtained for all the frequency bands.

In addition, the bitstream may include, for at least one of the frequency bands or for only the frequency band lower than a predetermined frequency, fourth coded data representing phase polarity information S which indicates which phase of the two audio signals is ahead of the other. The determination unit may determine, as the phase rotators, either two complex numbers $e^{-j\alpha}$ and $e^{j\beta}$ or conjugate complex numbers $e^{j\alpha}$ and $e^{-j\beta}$ of the complex numbers $e^{-j\alpha}$ and $e^{j\beta}$ for each of the frequency bands. The separation unit may generate the two separation signals in the following different ways depending on a frequency band: by multiplying, with the frequency domain signal generated by the transformation unit, the respective determined complex numbers, for a frequency band for which fourth coded data is not included in the bitstream; and by multiplexing, with the frequency domain signal generated by the transformation unit, either the determined two complex numbers or conjugate complex numbers associated with the phase polarity information S indicated as the fourth coded data, for the frequency band for which fourth coded data is included in the bitstream.

With this structure, the whole signals are reproduced with high accuracy by separating the signals on a per frequency band basis using an appropriate phase rotation. In particular, when considering that human auditory sensitivity to an advancement or a delay of a phase lowers in a comparatively high frequency band, handling the phase polarity information S only in the frequency band lower than the predetermined frequency makes it possible to reduce the amount of information to be coded without deteriorating auditory sound quality.

Further, the present invention can be realized not only as an audio decoder, but also as an audio decoding method having the processing steps to be executed by the unique units that the above-mentioned audio decoder has, and a computer program of the same. In addition, the present invention can be realized as an integrated circuit device for audio decoding.

Effects of the Invention

With the audio decoder of the present invention, the absolute phase of two audio signals based on a downmix signal are reproduced from the dowmmix signal obtained by downmixing the two audio signals and the gain ratio D and phase difference θ of the two audio signals. Therefore, the accuracy in reproducing the signals is improved compared to that in the conventional art where only a relative phase difference θ of the two audio signals is reproduced.

BRIEF DESCRIPTION OF DRAWINGS

FIG. 3 is a diagram showing how gain ratio information, phase difference information and phase polarity information are stored.

FIG. 8 is a diagram showing a codebook to code a phase difference.

FIG. 9 is a diagram showing a codebook to code a phase difference in the case of using a low bit rate.

Figure 1:
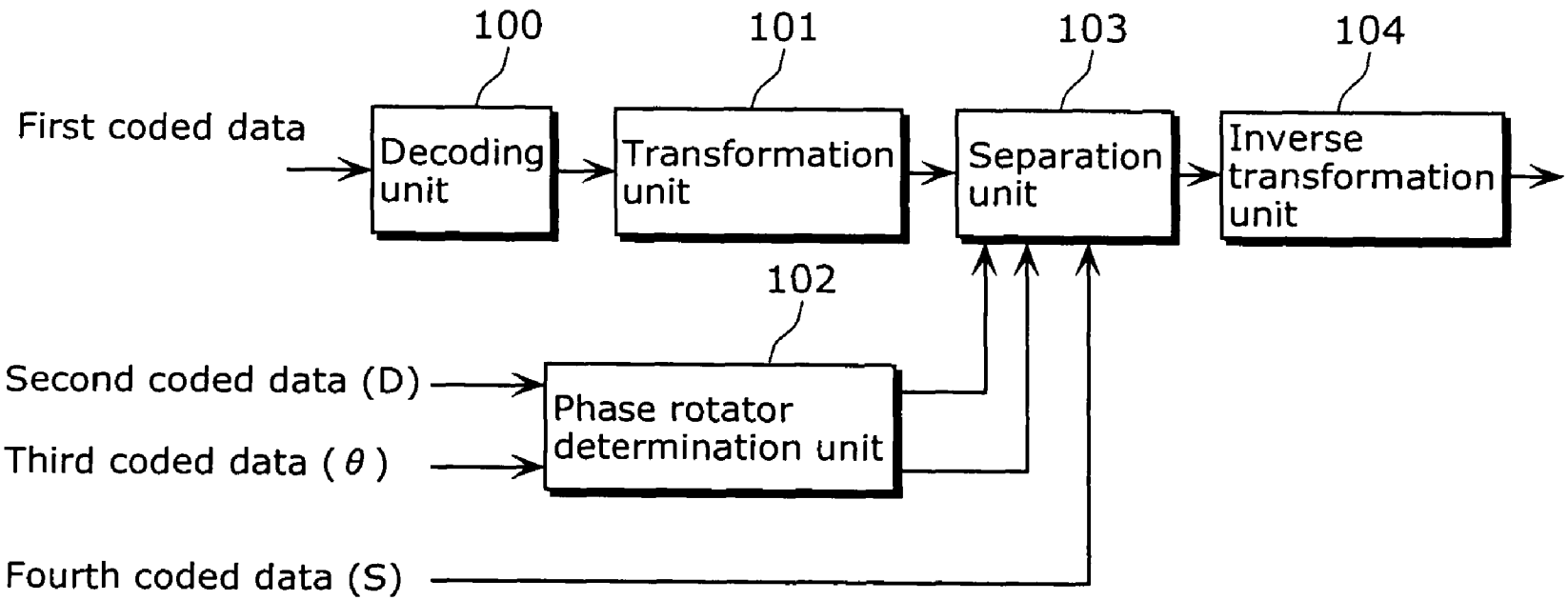
FIG. 1 is a diagram showing the structure of the audio decoder in a first embodiment.

| Numerical References | |
|---|---|
| 100 | decoding unit 100 |
| 101 | transformation unit 101 |
| 102 | phase rotator determination unit 102 |
| 103 | separation unit 103 |
| 104 | inverse transformation unit 104 |
| 200 | first coded data storage area |
| 201 | second coded data storage area |
| 202 | third coded data storage area |
| 203 | fourth coded data storage area |
| 700 | first coding unit 700 |
| 701 | first transformation unit 701 |
| 702 | second transformation unit 702 |
| 703 | first separation unit 703 |
| 704 | second separation unit 704 |
| 705 | third separation unit 705 |
| 706 | fourth separation unit 706 |
| 707 | second coding unit 707 |
| 708 | third coding unit 708 |
| 709 | formatter |

DETAILED DESCRIPTION OF THE INVENTION

First Embodiment

The audio decoder in a first embodiment of the present invention will be described with reference to the drawings.

FIG. 1 is a diagram showing the structure of the audio decoder in the first embodiment. The audio decoder shown in FIG. 1 reproduces two audio signals by decoding a bitstream which includes: first coded data indicating a downmix signal obtained by downmixing the two audio signals; second coded data indicating the gain ratio D of the two audio signals; third data indicating the phase difference θ of the two audio signals; and fourth coded data representing the phase polarity information S showing the signals with the advanced phase among the two audio signals. The audio decoder is structured with a decoding unit 100, a transformation unit 101, a phase rotator determination unit 102, a separation unit 103 and an inverse transformation unit 104.

The decoding unit 100 decodes the first coded data into the downmix signal. The transformation unit 101 transforms the downmix signal generated by the decoding unit 100 into a signal of the frequency domain.

The phase rotator determination unit 102 determines two phase rotators having phase rotation angles. The respective phase rotation angles correspond to angles α and β obtained by dividing, by a diagonal line, a contained angle of a parallelogram where the contained angle of two adjacent sides equals the phase difference θ indicated by the third coded data, and the ratio of the lengths of the two adjacent sides equals the gain ratio D indicated by the second coded data.

The separation unit 103 separates these two separation signals using the two phase rotators and the gain ratio D from the frequency domain signal generated by the transformation unit 101, and the inverse transformation unit 104 reproduces the two audio signals by inversely transforming the two separation signals into signals of time domain.

Figure 2:
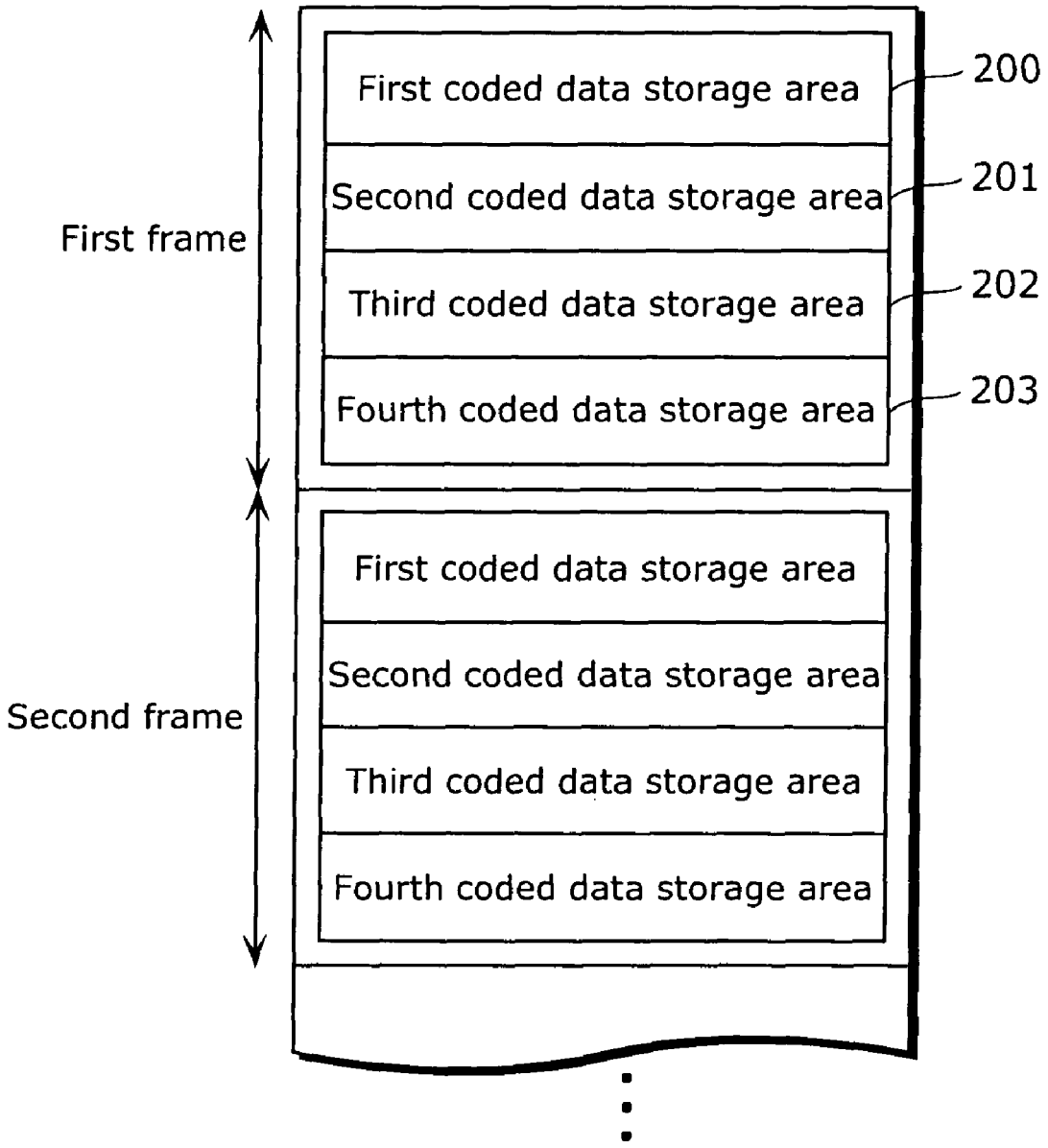
FIG. 2 is a diagram briefly showing the structure of a bitstream to be an input into the audio decoder.

FIG. 2 is a diagram briefly showing the structure of a bitstream to be an input into the audio decoder. In the bitstream, the earlier-mentioned first to fourth coded data are stored in each of frames prepared at a predetermined interval, but FIG. 2 shows only two frames.

Data related to the first frame is stored in a first coded data storage area 200, a second coded data storage area 201, a third coded data storage area 202, and a fourth coded data storage area 203 respectively. The same structure is repeated in the second frame.

It is assumed that a signal obtained by compressing a downmixed signal using the AAC format in the MPEG standard is stored in the first coded data storage area 200. The downmixed signal is obtained by downmixing, for example, two-channel signals.

Here, vector synthesis processing of signals is referred to as downmixing.

In the second coded data storage area 201, a value indicating the gain ratio D of the two-channel signals is stored. In the third coded data storage area 202, a value indicating the phase difference θ of the two-channel audio signals is stored. In the fourth coded data storage area 203, a value indicating the phase polarity information S indicating the two-channel audio signals with the advanced phase among the two-channel audio signals is stored.

It should be noted that the value indicating the phase difference θ is not always the one obtained by directly coding the phase difference θ, and for example, it may be data obtained by coding a value such as cos θ. In this case, the phase difference θ can be indicated within the range from 0 degree to 180 degrees by the value of cos θ.

FIG. 3 is a diagram showing which pieces of gain ratio information, phase difference information, and phase polarity information are stored in the respective second coded data storage area 201, the third coded data storage area 202, and the fourth coded data storage area 203. FIG. 3 shows that the gain ratio information is stored in each of twenty-two frequency bands. Twenty-two pieces of gain ratio information in total are stored. For example, the first gain ratio information relates to the band from 0.000000 kHz to 0.086133 kHz, and the second gain ratio information relates to the band from 0.086133 kHz to 0.172266 kHz. Similarly, it is shown that nineteen pieces of phase difference information are stored.

Similarly, it is shown that eleven pieces of phase polarity information are stored. How to divide the frequency domain and the number of divisions, and the like shown in FIG. 3 are mere examples, and they may be other values.

In addition, the number of pieces of phase difference information is fewer than the number of pieces of gain ratio information in FIG. 3. This is because the auditory sense is characteristic in being more sensitive to the gain ratio information in general. However, the number of pieces of phase difference information and the number of pieces of gain ratio information may be the same depending on a compression bit rate and a sampling frequency of audio signals to be handled.

Additionally, this is true of the phase polarity information. In this embodiment, the pieces of phase polarity information related to the bands approximately up to 1 kHz are stored, but the pieces of phase polarity information related to the bands that equal or exceed 1 kHz are not stored. Additionally, in the case of a low bit rate, no phase polarity information is stored. This stems from the characteristic that the auditory sense is not so sensitive to the phase polarity information. In the case where a compression bit rate can be increased, it is better in a view of sound quality to store all the pieces of phase polarity information covering the whole bands.

Operations of the audio decoder structured in this way are described below.

First, the decoding unit 100 decodes the first coded data stored in the bitstream. As shown in FIG. 2, the first coded data is obtained by downmixing two-channel audio signals (simply referred to as original signals) into a single downmix audio signal and coding the downmix audio signal using AAC. Thus, the decoding unit 100 can be realized as a normal AAC decoder which decodes a bitstream having an AAC format.

Next, the transformation unit 101 transforms the signals decoded by the decoding unit 100 into signals in the frequency domain. In this embodiment, the signals decoded in the frequency domain by the decoding unit 100 using, for example, a Fourier transform are transformed into a complex Fourier series in the frequency domain. Further, the transformed complex Fourier series is divided into groups of twenty-two frequency bands as shown in the left-most column in FIG. 3.

Here, a Fourier transform is taken as an example, but the Fourier transform is not always needed, such that the QMF filter bank by complex numbers may be used.

In addition, the phase rotator determination unit 102 calculates phase rotators having phase rotation angles of α and β in accordance with the second coded data and the third coded data.

Here, the second coded data is the value indicating the gain ratio of two-channel original signals in each frequency band. As shown in FIG. 3, a gain ratio D is stored in each of the twenty-two bands in a bitstream. Thus, gain ratio information can be obtained by extracting them. In addition, the third coded data is the value indicating the phase difference of the two-channel original signals in each frequency band. As shown in FIG. 3, a phase difference θ is stored in each of the nineteen-nine bands in a bitstream. Thus, phase difference information can be obtained by extracting them.

How to calculate the phase differences α and β between the downmix signal and the respective two-channel signals from the gain ratio D and the phase difference θ is described below with reference to FIG. 4 and FIG. 5.

Figure 4:
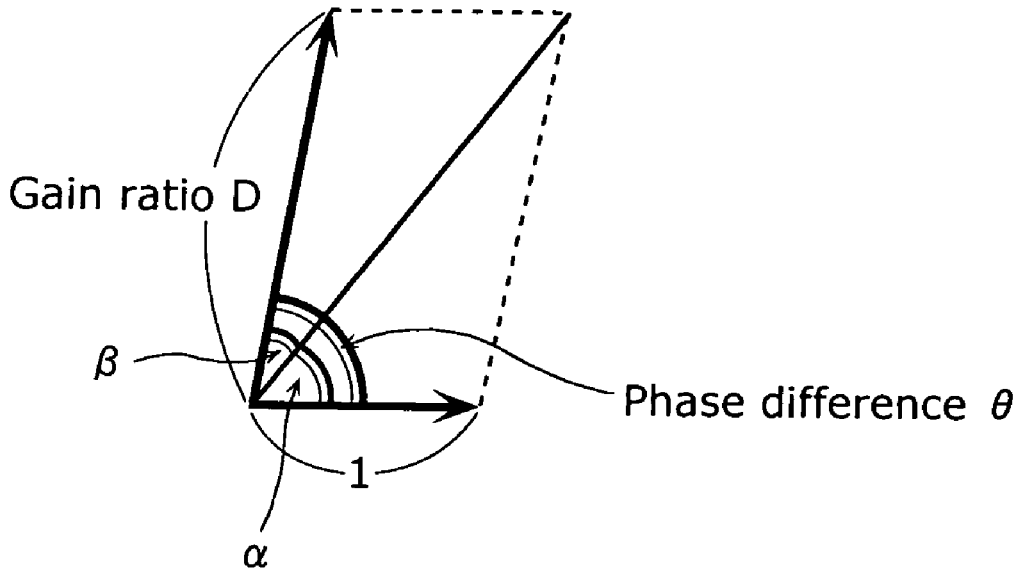
FIG. 4 is a diagram showing an example of the states of a gain ratio D and a phase difference θ.

FIG. 4 shows an example of the states of a gain ratio D and a phase difference θ. The downmix signal is in a direction of a diagonal line in a parallelogram having two sides which are two arrows indicating the original signals. Thus, the phase differences α and β between the downmix signal and the respective original signals appear in the places shown in FIG. 4.

Figure 5:
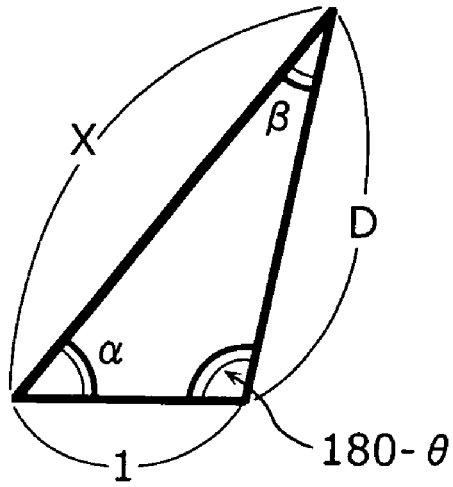
FIG. 5 is a diagram showing the concept of geometrically calculating the phase differences α and β.

FIG. 5 is a diagram showing the concept of geometrically calculating phase differences α and β. FIG. 5 shows a triangle divided by an orthogonal line in the parallelogram of FIG. 4. When the length of the diagonal line is X, in the triangle, the lengths of the sides are 1, D and X, and the angles formed by these sides are α, 180-θ, and β. Here, the cosine law of trigonometric functions is used as follows:

$$X^2=1+D^2-2D\cos(180-\theta)=1+D^2+2D\cos\theta; \quad \text{(Equation 1)}$$

$$1=X^2+D^2-2DX\cos\beta;\ \text{and} \quad \text{(Equation 2)}$$

$$D^2=1+X^2-2X\cos\alpha. \quad \text{(Equation 3)}$$

From the Equation 1, $X=(1+D^2+2D\cos\theta)^{0.5}$.

By substituting this into Equation 2 and Equation 3, the following Equations can be obtained.

$$\alpha=\arccos((1+D\cos\theta)/((1+D^2+2D\cos\theta)^{0.5})),\ \text{and} \quad \text{(Equation 4)}$$

$$\beta=\arccos((D+\cos\theta)/((1+D^2+2D\cos\theta)^{0.5})). \quad \text{(Equation 5)}$$

In other words, the phase rotator determination unit 102 calculates the phase differences α and β according to the above Equations 4 and 5, and calculates the phase rotators in accordance with the phase differences α and β. Since the above description is a mathematical basis, a real calculation process may be performed by performing approximate calculation or by referring to a table of trigonometric functions.

Figure 10:
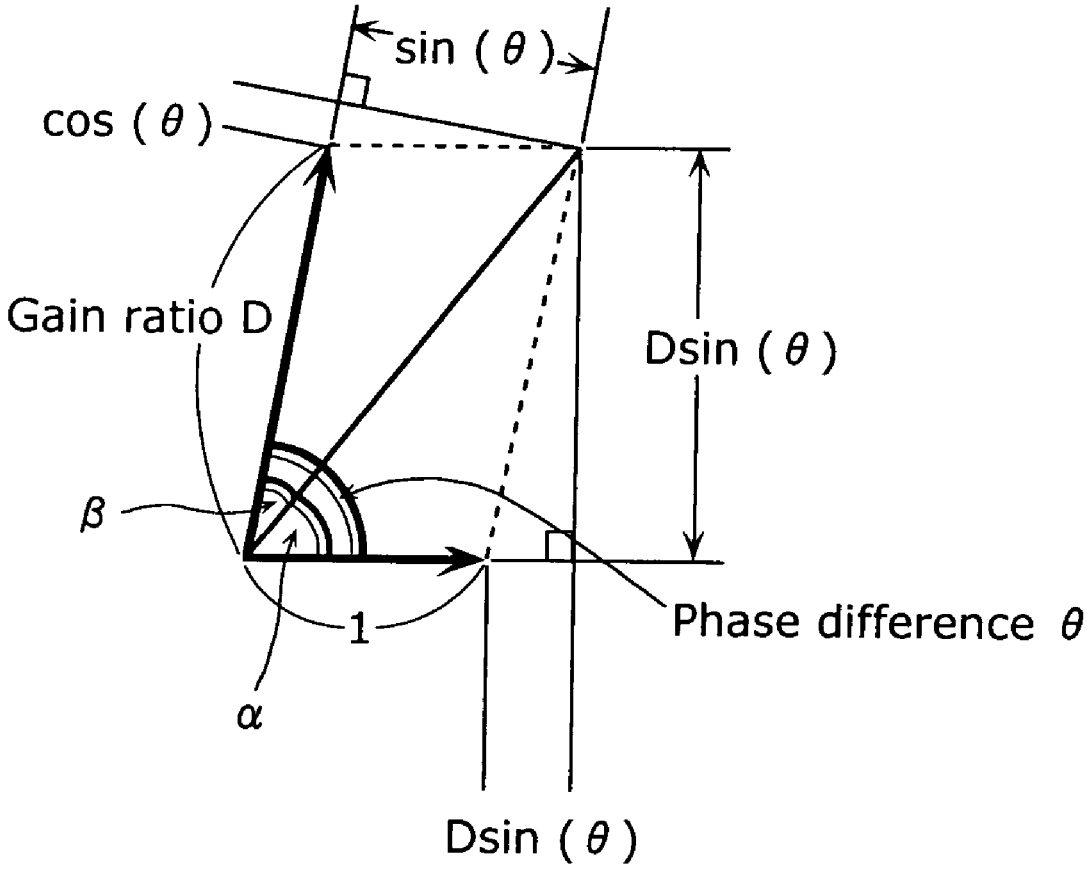
FIG. 10 is a diagram showing another concept of geometrically calculating phase differences α and β.

In addition, the cosine law needs not to be used directly. For example, the question of solving the α and β may be regarded as a geometrical question shown as FIG. 10, and may be calculated as the following:

$$\alpha=a\tan(D\sin(\theta)/(1+D\cos(\theta)));\ \text{and}$$

$$\beta=a\tan(\sin(\theta)/(D+\cos(\theta))).$$

In other words, when the phase rotation angles α and β are calculated from the phase difference θ and gain ratio D of the two original audio signals are calculated, in a parallelogram where the ratio of two adjacent sides is D and the contained angle is θ, the phase rotation angles α and β should be calculated as the angles obtained by dividing the contained angle by a diagonal line of the parallelogram.

In addition, the phase rotator determination unit 102 calculates the phase rotation angles α and β in the above description. However, actually, the values of phase rotation angles α and β are not directly needed, and the needed ones are rotators $e^{j\alpha}$ and $e^{-j\beta}$ for rotating the phase or $e^{-j\alpha}$ and $e^{j\beta}$ which are the conjugate complex numbers of the rotators $e^{j\alpha}$ and $e^{-j\beta}$. The phase rotator determination unit 102 needs to calculate values of trigonometric functions. In other words, it is sufficient to calculate the values of trigonometric functions. The needed values of trigonometric functions are as follows:

cos α . . . (the real part of $e^{j\alpha}$);
sin α . . . (the imaginary part of $e^{j\alpha}$);
cos β . . . (the real part of $e^{j\beta}$); *and*
sin β . . . (the imaginary part of $e^{j\beta}$).

In other words, the rotator β itself is calculated using an arccos calculation in the earlier-mentioned calculation for obtaining rotators α and β, but this is unnecessary. The right sides of the following Equations may be calculated as assuming that:

$$\cos\alpha=(1+D\cos\theta)/((1+D^2+2D\cos\theta)^{0.5});\ \text{and} \quad \text{(Equation 6)}$$

$$\cos\beta=(D+\cos\theta)/((1+D^2+2D\cos\theta)^{0.5}). \quad \text{(Equation 7)}$$

As to sin α and sin β, they can be easily calculated using the Pythagorean theorem $((\cos X)^2+(\sin X)^2=1)$ or the like.

Further, the separation unit 103 separates the frequency domain signal transformed by the transformation unit 101 into two signals using the two phase rotation angles α and β, and the forth coded data. This process is described using FIGS. 6A and 6B.

Figure 6A:
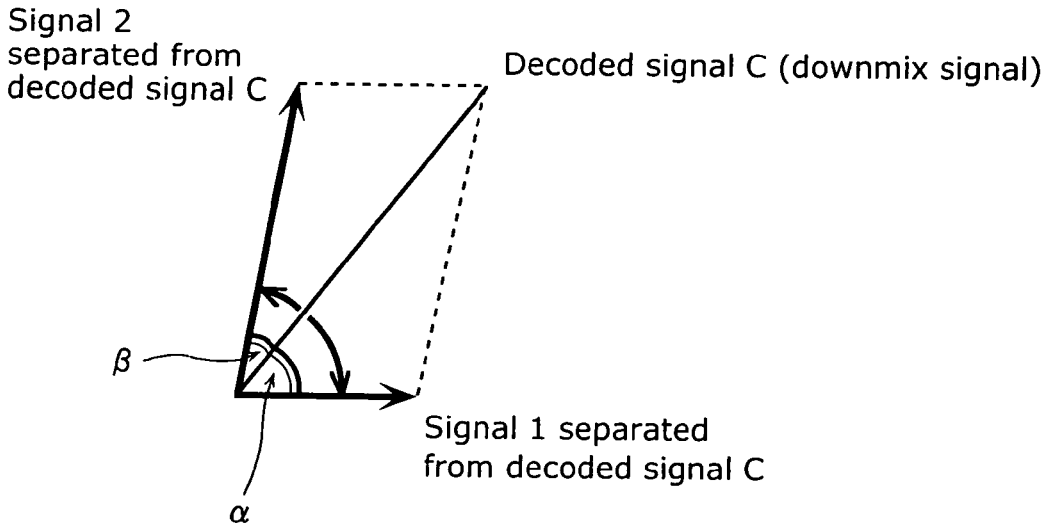
FIG. 6A is a diagram showing the relationship between the downmix signal and the original two-channel signals.

FIG. 6A is a diagram showing the relationship between the two-channel original signals which should be separated and the downmix signal obtained by downmixing the original signals. The long arrow in the center is the decoded signal. Since the decoded signal is transformed in Fourier series in this embodiment, this arrow is a vector in a complex plane. When this vector is C, in order to rotate the phase by −α, complex number $e^{-\alpha}$ should be used, and the complex numbers indicated as $*e^{-\alpha}$ should be multiplied. Similarly, in order to rotate the phase of the vector C by β, complex number $e^{j\beta}$ should be used, and the complex numbers indicated as $*e^{j\beta}$ should be multiplied.

Figure 6B:
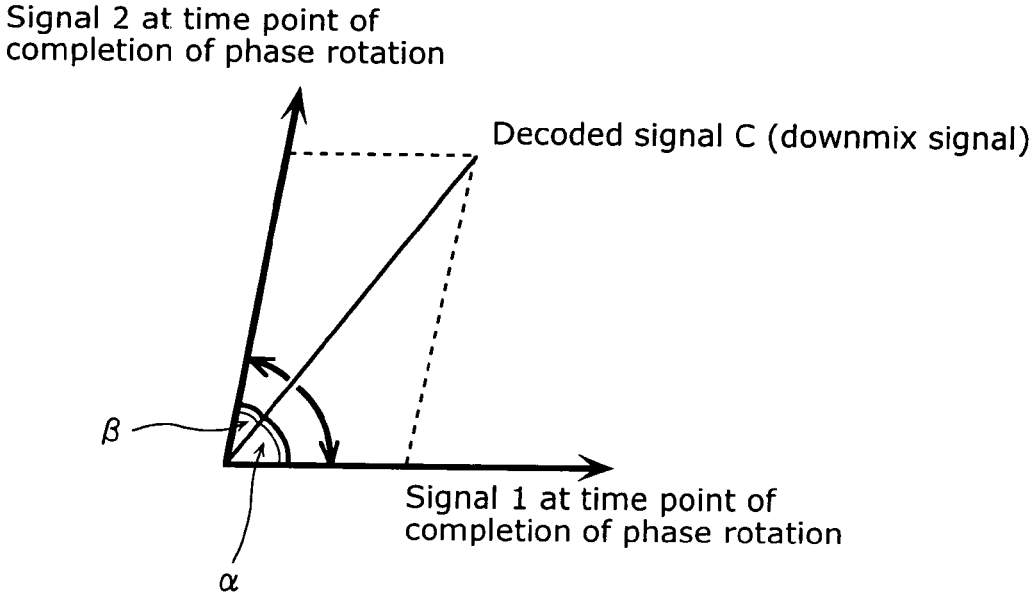
FIG. 6B is a diagram showing the relationship between the downmix signal and a signal 1 and a signal 2 at the time when the phase rotation is completed.

At the time when this multiplication of the phase rotators is performed, the phase of the vector C indicating the decoded signal is rotated by −α and +β, and as a result, two vectors indicating a signal 1 and a signal 2 at the time when the phase rotation is completed can be obtained as shown in FIG. 6B. The lengths of the vectors equal to the length of the vector C.

Next, in order to perform a gain correction in accordance with the amplification of the signals to be separated, the vector of the signal 1 rotated by −α is multiplied with a correction value of $1/((1+D^2+2D\cos\theta)^{0.5})$, and the vector of the signal 2 rotated by +β is multiplied with a correction value of $D/((1+D^2+2D\cos\theta)^{0.5})$. This correction is based on the fact that, in a parallelogram where the length ratio of two adjacent sides is D and the contained angle is θ, the length of a diagonal line of the parallelogram is $((1+D^2+2D\cos\theta)^{0.5})$.

Since the length of the diagonal line is $((1+D^2+2D\cos\theta)^{0.5})$ in the above description, it has been described that the gain is corrected by multiplying the respective signals with $1/((1+D^2+2D\cos\theta)^{0.5})$ and $D/((1+D^2+2D\cos\theta)^{0.5})$ respectively. However, it should be noted that a gain correction method is not limited thereto in the case where such gain adjustment is performed on the downmix signal itself based on the phase difference. For example, there is a case where the following processing is performed at the time of coding.

In other words, in the case where the gain of the first signal is 1 and the gain of the second signal is D, and the phase difference of the signals is θ, the energy of the pre-downmix signals is indicated as $(1+D^2)^{0.5}$. On the other hand, in the case where the energy of the downmix signal is indicated as $(1+D^2+2D\cos\theta)^{0.5}$, the energy of the downmix signal in accordance with the θ differs from the energy of $(1+D^2)^{0.5}$ that the original signals have.

More specifically, the energy $(1+D^2+2D\cos\theta)^{0.5}$ of the downmix signal matches the energy $(1+D^2)^{0.5}$ that the original signals have in the case where the phase difference between the downmix signal and the original signals is 90 degrees. However, the energy difference becomes greater as the phase difference nears 0 degrees, and the energy difference becomes smaller as the phase difference nears 180 degrees. In other words, according to this indication, the energy of the downmix signal obtained from the in-phase becomes too large, and the energy of the downmix signal obtained from the opposite phase becomes too small.

For this reason, adjustment by multiplying the downmix signal with $(1+D^2)^{0.5}/(1+D^2+2D\cos\theta)^{0.5}$ may be performed so that the energy of the downmix signal matches the energy that the original signals have irrespective of the phase difference.

In the case where such adjustment is performed at the time of coding, in decoding, in order to return to the original gain by releasing energy adjustment to the downmix signal itself at the coding, the downmix signal is multiplied with $(1+D^2+2D\cos\theta)^{0.5}/(1+D^2)^{0.5}$ first, and at the time of subsequent division by the phase angle, the respectively separated signals are multiplied with the earlier-mentioned $1/((1+D^2+2D\cos\theta)^{0.5})$ or $D/((1+D^2+2D\cos\theta)_{0.5})$.

Through this continuous multiplication, $(1+D^2+2D\cos\theta)^{0.5}$ in the denominator is compensated with $(1+D^2+2D\cos\theta)^{0.5}$ in the numerator, and $1/((1+D^2)^{0.5}$ or $D/((1+D^2)^{0.5})$ is processed as a multiplier for the correction of the gain ratio. In this case, the gain is corrected by multiplying the respective signal 1 and signal 2 at the time when the phase rotation is completed with the respective multipliers $1/((1+D^2)^{0.5})$ and $D/((1+D^2)^{0.5})$ which depend on only the gain ratio D.

Through the vector rotation and length correction like this, the downmix signal can be separated into two signals of the signal 1 and the signal 2 as shown in FIG. 6A.

The separation unit 103 performs the above processing on a per frequency band shown in FIG. 3. It should be noted here that only a piece of phase difference information per two pieces of gain ratio information may exist in the higher frequency band, and in this case, the piece of phase difference information is shared.

In addition, the phase rotations are performed by −α and +β (in other words, the rotators $e^{-j\alpha}$ and $e^{j\beta}$ are used) in an example in the above description, but −α and +β may be +α and −β depending on the relationship of an advancement and a delay of the phases of the original signals. The relationship between the decoded signal and the original signals to be separated is indicated by a parallelogram (not shown) obtained by turning the parallelogram shown in FIG. 6A inside out, and the rotators which should be used at this time are conjugate complex numbers $e^{j\alpha}$ and $e^{-j\beta}$.

The information for processing this accurately is the fourth coded data; that is, the phase polarity information. As shown in FIG. 3, phase polarity information exists in each of the lower 11 frequency bands in a bitstream. By using this information, the rotation direction of the phase can be determined accurately. The separation unit 103 separates the downmix signal into two signals using either the two complex numbers determined by the phase rotator determination unit 102 or the conjugate complex numbers associated with the phase polarity information.

This phase polarity information is unnecessary in the frequency band where human auditory sense is less sensitive to the phase polarity. Hence, the phase polarity information is not always required in all of the frequency bands. In the frequency bands where no phase polarity information exists, the separation unit 103 separates the downmix signal into two signals directly using the two complex numbers determined by the phase rotator determination unit 102.

Figure 11:
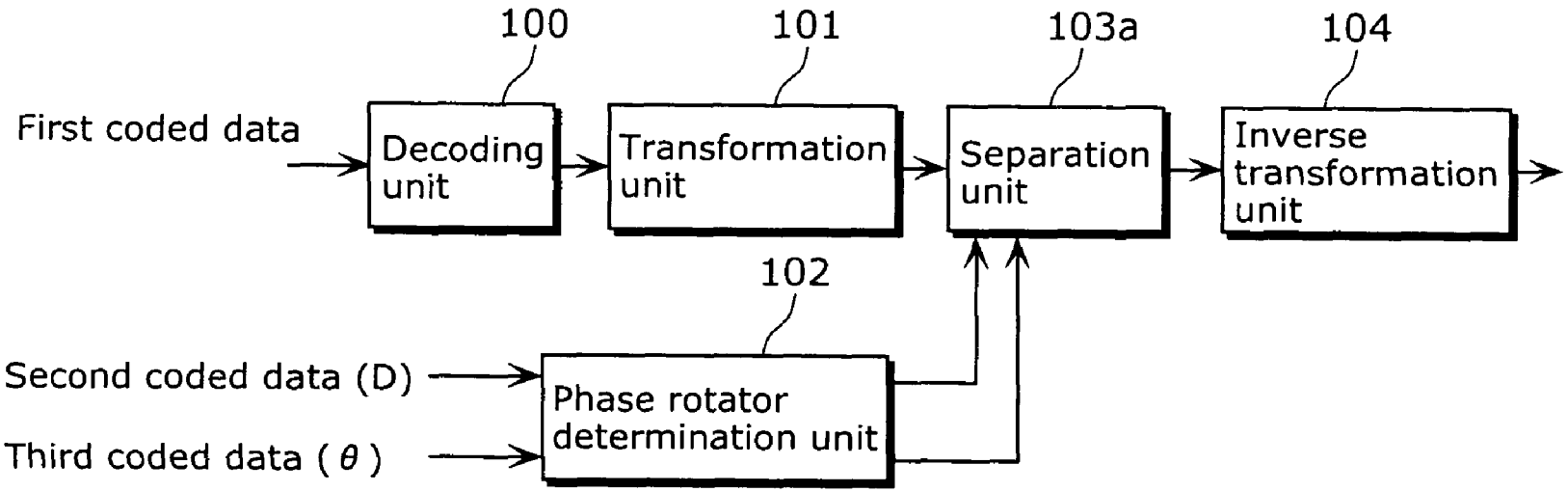
FIG. 11 is a diagram showing the structure of the audio decoder in a variation.

In the case of a low bit rate, a variation where no phase polarity information exists is conceivable. FIG. 11 shows an example of the structure of the audio decoder according to the variation like this. The audio decoder according to this variation differs from the audio decoder that handles phase polarity information (refer to FIG. 1) in that the fourth coded data (S) is omitted, and the separation unit 103*a* separates the downmix signal into two signals directly using the two complex numbers determined by the phase rotator determination unit 102 in all the frequency bands.

Since it is clearly shown that the state of the phase that the downmix signal has shows the state of the phase of the signal having the greater energy among the original two signals in the case where no phase polarity information exists and the phase difference θ is 180 degrees; that is, the original two signals have the opposite or approximately opposite phases, both the α and β may be 0 degrees. In this case, the signal which originally has the phase of 180 degrees has the opposite phase, at least the phase of the signal having the greater energy is maintained accurately.

Lastly, the inverse transformation unit 104 inversely transforms the frequency domain signal generated by the separation unit 103 into signals in the time domain. Since the transformation unit 101 calculates complex Fourier series through Fourier transform in this embodiment, the inverse transformation unit 104 performs inverse Fourier transform.

As described above, the audio encoder in this embodiment decodes a bitstream and reproduces two audio signals. The bitstream includes first coded data indicating a downmix signal obtained by downmixing the two audio signals. Second coded data indicates a gain ratio D between the two audio signals, and third coded data indicates a phase difference θ between the two audio signals. The audio decoder includes: a decoding unit which decodes the first coded data into the downmix signal; a transformation unit which transforms the downmix signal decoded by the decoding unit into a frequency domain signal; a determination unit which determines two phase rotators which respectively form a phase rotation angle α and a phase rotation angle β which are obtained by diagonally dividing a contained angle formed by two adjacent sides in a parallelogram where a length ratio between the sides is equal to the gain ratio D indicated in the second coded data, and also, the contained angle is equal to the phase difference θ indicated in the third coded data; a separation unit which separates, using the two phase rotators and the gain ratio D which is indicated in the second coded data, the frequency domain signal into two separation signals which respectively indicates a phase difference θ and a phase difference θ with respect to the downmix signal; and an inverse transformation unit which inversely transforms the respective two separation signals into time domain signals so as to reproduce the two audio signals. With this structure, the absolute phase of the two audio signals is reproduced based on the downmix signal obtained by downmixing the two-channel audio signals into one-channel signal and a small amount of supplementary information indicating the phase difference and gain ratio of the audio signals. Therefore, the accuracy in reproducing the signals is improved compared with those in the conventional art where only a relative phase difference θ of the two audio signals is reproduced.

In the description in this embodiment, the one-channel signal obtained by downmixing the two-channel signals is processed, but the invention is not limited thereto. The invention described in the present application may be used, for example, in the case where: four-channel signals of front-Left, front-Right, rear-Left, and rear-Right are downmixed in a way that the front-Left and the rear-Left are downmixed and the front-Right and the rear-Right are downmixed, and further, the respective downmix signals are further downmixed; and the downmix signal is separated by a Left signal and a Right signal and then the respective Left and Right signals are further separated into front and rear signals.

In addition, this embodiment requires to cause the phase rotator determination unit 102 and the separation unit 103 to calculate trigonometric functions, and thus an inexpensive processor or the like has difficulty in executing the processing. However, the use of an idea described below makes it possible to perform the processing very easily.

First, the phase rotator determination unit 102 calculates the phase differences α and β based on the phase differences θ and the gain ratio D. However, the separation unit 103 does not use the phase differences α and β as they are when executing the phase rotation processing, but actually uses the values of $e^{(+/-)j\alpha}$ and $e^{(+/-)j\beta}$; that is:

$$e^{(+/-)j\alpha}=\cos\alpha(+/-)j\sin\alpha;\text{ and}$$

$$e^{(-/+)j\beta}=\cos\beta(-/+)j\sin\theta.$$

The above Equations correspond to:

$$\cos\alpha=(1+D\cos\theta)/((1+D^2+2D\cos\theta)^{0.5});\quad\text{(Equation 8)}$$

$$\sin\alpha=(D\sin\theta)/((1+D^2+2D\cos\theta)^{0.5});\quad\text{(Equation 9)}$$

$$\cos\beta=(D+\cos\theta)/((1+D^2+2D\cos\theta)^{0.5});\text{ and}\quad\text{(Equation 10)}$$

$$\sin\beta=\sin\theta/((1+D^2+2D\cos\theta)^{0.5}).\quad\text{(Equation 11)}$$

Preparing a reference table having addresses of phase difference information θ associated with a cos θ and sin θ eliminates the necessity of the processing of trigonometric functions, and thus the processing include only addition, multiplication, division, and square root calculation. Further writing cos θ and sin θ in adjacent areas in the table at this time, both of the values can be easily extracted by a simple addressing. In particular, since most of the recent processors are equipped with a data transfer route (data bus) having a width of 64 bits, writing cos θ and sine θ in adjacent areas makes it possible to extract both the values by a machine cycle.

Further, cos α, sin α, cos β and sin β are uniquely determined based on a phase difference information θ and the gain ratio information D, preparing a two-dimensional table having addresses of phase difference information θ and gain ratio information makes it possible to extract the cos α, sin α, cos β and sin β which are the values necessary for an actual calculation only by accessing the table. Also in this case, writing the values of cos α, sin α, cos β and sin β each related to a combination made up of the same phase difference information θ and gain ratio information D in adjacent areas makes it possible to extract all of the values only by a simple addressing.

To be more realistic, as a detailed description has been made as to the signal separation process with reference to FIGS. 6A and 6B, the values to be finally used for the signal separation are obtained by multiplying the respective values of cos α, sin α, cos β and sin β for executing the phase rotation processing with correction values for correcting the lengths of the vectors indicating the separated signals. The lengths are the gains of the signals.

For this reason, it is desirable that the correction values are indicated as function values of F1(D, θ) and F2(D, θ) and store the following corrected values instead of storing the values of the cos α, sin α, cos β and sin β as they are:

$$\cos\alpha*F1(D,\theta);$$

$$\sin\alpha*F1(D,\theta);$$

$$\cos\beta*F2(D,\theta);\text{ and}$$

$$\sin\beta*F2(D,\theta).$$

Here, conveniently, both of the function values F1(D, θ) and F2(D, θ) are functions including D and θ, and the table which is being currently considered is a two-dimensional table to be addressed using D and θ. This makes it possible to store and refer to the corrected values in this table without increasing the memory size and the complexity in the access procedure.

Here, in the description of the signal separation process, the respective function values F1(D, θ) and F2(D, θ) are:

$$F1(D,\theta)=1/((1+D^2+2D\cos\theta)^{0.5}); \text{ and}$$

$$F2(D,\theta)=D/((1+D^2+2D\cos\theta)^{0.5}).$$

However, in the processing of an actual coding standard, they may be:

$$F1(D,\theta)=1/((1+D^2)^{0.5}); \text{ and}$$

$$F2(D,\theta)=D/((1+D^2)^{0.5}).$$

Hence, it is good to appropriately adjust correction values as described above in compliant with an actual coding standard.

Note that the MPEG Enhanced AAC+SBR scheme (ISO 14496-3: AMENDMENT 2) which has been disclosed recently discloses the method for separating the signal obtained by downmixing two audio signals into the original two audio signals using a reverberation signal generated according to the method of using an all-pass filter to the downmix signal, in addition to using the phase difference θ and the gain ratio D of the two audio signals. However, the phase rotation angles α and β are simply equally allocated, for example, +θ/2 and −θ/2.

The approach described in the present application excels in separation performance over the conventional approach because this approach is for precisely calculating the phase rotation angles based on the geometrical theory. Therefore, introducing the approach of the present application in the implementation of the Enhanced AAC+SBR decoder makes it possible to obtain high picture quality without adding any modification on a bitstream, that is, by using a compatible stream. In other words, the approach described in this embodiment of the present invention may be combined with an approach of using a reverberation signal.

In the MPEG Enhanced AAC+SBR scheme (ISO 14496-3: AMENDMENT 2), the gain ratios D are coded as Inter-channel Intensity Differences (IID). Additionally, the phase differences θ are coded as Inter-channel Phase Differences (IPD) or Inter-channel Coherence (ICC). In particular, ICCs are the indices indicating the correlation strength between these two audio signals. When this value is a big positive value, there is a strong correlation, that is, the phase difference is small. When this value is close to 0, there is no correlation, that is, the phase difference is approximate to 90 degrees. When this value is a big negative absolute value, there is a strong negative correlation, that is, the phase difference is approximate to 180 degrees. In this way, ICCs can be used as parameters indicating the phase differences between these two audio signals.

Further conveniently, since ICCs have the above characteristics, an ICC indicates the value of cos θ with reference to the phase difference θ between the two audio signals. When the ICCs are the values of cos θ, the ICCs may be directly used as the values of cos θ in the above-described Equation 6 to Equation 11, and thus the calculation is extremely simplified.

In addition, in the case where the reverberation signal is used, there are cases where a sound sharpness may be lost depending on the nature of the audio signal to be processed. Example cases include: the case where the phase difference between the original two audio signals is great, that is, the phases are approximately opposite phases; the case where the gain ratio between the original two audio signals is great, that is, the phases are approximately opposite phases; and the case of an abrupt change in amplification; that is, in the case of the audio signal containing a strong attach component. In such cases, any reverberation signal may not be used. Otherwise, multiple methods for generating reverberation signals may be prepared, and the method to be selected may be switched depending on the nature of the audio signals to be processed.

At this time, the decoder side is capable of executing a judgment of the nature of the audio signals to be processed. Therefore, by switching control depending on the judgment makes it possible to obtain high sound quality without adding any modification on a bitstream, that is, by using a compatible stream.

Preparing a flag as to whether a reverberation signal is used on the bitstream eliminates such judgment by the decoder side in the new coding standard. This makes it possible to mount a decoder lightly. Otherwise, preparing a flag indicating which method is used for generating a reverberation signal eliminates such judgment by the decoder side. This makes it possible to mount a decoder lightly.

Here, a method of preparing multiple methods for generating reverberation signals includes a method of preparing multiple amounts of phase shift for generating reverberation signals.

In addition, the approach of calculating separation angles, the approach of simply equally allocating separation angles or the like which have been described may be appropriately switched depending on the nature of a signal. Additionally, a flag is designed into a bitstream for such switching.

In addition, a method may be fixed as an approach for calculating separation angles, and a flag as to whether a reverberation signal is used may be designed into a bitstream.

Second Embodiment

The audio encoder in a second embodiment of the present invention will be described below with reference to the drawings.

Figure 7:
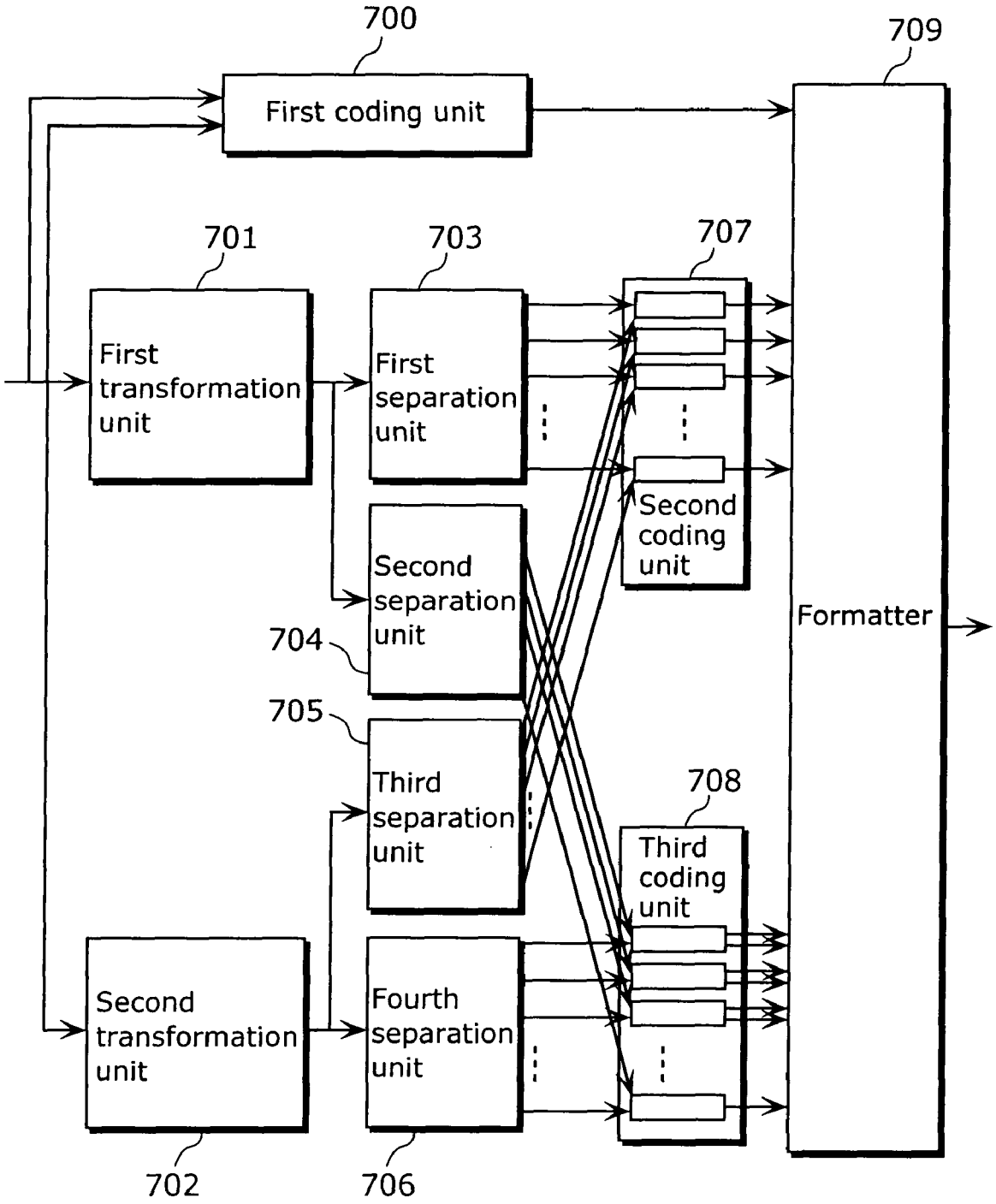
FIG. 7 is a diagram showing the structure of the audio encoder in a second embodiment.

FIG. 7 is a diagram showing the structure of the audio encoder in the second embodiment. This audio encoder generates a bitstream to be excellently decoded by the audio decoder described in the first embodiment. The encoder includes: a first coding unit 700, a first transformation unit 701, a second transformation unit 702, a first separation unit 703, a second separation unit 704, a third separation unit 705, a fourth separation unit 706, a second coding unit 707, a third coding unit 708, and a formatter 709.

The first coding unit 700 encodes a downmix signal obtained by downmixing two audio signals.

The first transformation unit 701 transforms the first audio signal into a signal in the frequency domain. The second transformation unit 702 transforms the second audio signals into a signal in the frequency domain.

The first separation unit 703 separates the frequency domain signal generated by the first transformation unit 701 on a per frequency band basis. The second separation unit 704 separates the frequency domain signal generated by the first transformation unit 701 in a way different from that of the first separation unit 703.

The third separation unit 705 separates the frequency domain signal generated by the second transformation unit 702 in the same way as that of the first separation unit 703. The fourth separation unit 706 separates the frequency domain signal generated by the second transformation unit 702 in the same way as that of the second separation unit 704.

The second coding unit 707 detects gain ratios of a frequency-band signal separated by the first separation unit 703 and a frequency-band signal separated by the third separation unit 705 on a per frequency band basis, and encodes the respective gain ratios.

The third coding unit 708 detects phase differences of a frequency-band signal separated by the second separation unit 704 and a frequency-band signal separated by the fourth separation unit 706 on a per frequency band basis and information indicating which one of the signals has an advanced phase, and encodes the respective phase differences and the information.

The formatter 709 multiplies output signals of the first to third coding units.

Operations of the audio encoder structured as mentioned above are described.

First, the first coding unit 700 encodes the signal obtained by downmixing the two audio signals. Here, a method for the downmixing may be simply adding the two audio signals or adding the signals and multiplying the downmix signal with a predetermined coefficient. To summarize, any method may be used as long as the method is for synthesizing two audio signals. Any method for encoding may be used, but in this embodiment, encoding is performed according to the AAC scheme in the MPEG standard.

Next, the first transformation unit 701 transforms the first audio signal into a signal in the frequency domain. In this embodiment, the inputted audio signal is transformed into a complex Fourier series using a Fourier transform.

The second transformation unit 702 transforms the second audio signal into a signal in the frequency domain. In this embodiment, the inputted audio signal is transformed into a complex Fourier series using a Fourier transform.

Next, the first separation unit 703 separates the frequency domain signal generated by the first transformation unit 701 on a per frequency band basis. At this time, how to separate the signal is determined according to a table in FIG. 3. In FIG. 3, the starting frequencies of the frequency bands to be divided by the frequency band are shown in the left-most column. How the frequency band is actually divided in terms of gain ratio information is shown in the second-left column. In other words, the first separation unit 703 separates the frequency domain signal generated by the first transformation unit 701 for each of the respectively shown frequency bands according to the left-most and the second-left columns of the table in FIG. 3.

Likewise, the second separation unit 704 separates the frequency domain signal generated by the first transformation unit 701 on a per frequency band basis. At this time, how to separate the signal is determined according to a table in FIG. 3. In FIG. 3, the starting frequencies of the frequency bands to be divided by the frequency band are shown in the left-most column. How the frequency band is actually divided in terms of phase difference information is shown in the third-left column. In other words, the second separation unit 704 separates the frequency domain signal generated by the first transformation unit 701 for each of the respectively shown frequency bands according to the left-most and the third-left columns of the table in FIG. 3.

The third separation unit 705 separates the frequency domain signal generated by the second transformation unit 702 in the same separation way as that of the first separation unit 703.

The fourth separation unit 706 separates the frequency domain signal generated by the second transformation unit 702 in the same separation way as that of the second separation unit 704.

Next, the second coding unit 707 detects gain ratios of a frequency-band signal separated by the first separation unit 703 and a frequency-band signal separated by the third separation unit 705 on a per frequency band basis, and encodes the respective gain ratios. The method for detecting gain ratios here may be any method, for example, a method of comparing the largest amplification values of the frequency-band signals in each frequency band and a method of comparing the energy levels of the same. The gain ratios detected in this way are encoded by the second coding unit 707.

Next, the third coding unit 708 detects phase differences of a frequency-band signal separated by the second separation unit 704 and a frequency-band signal separated by the fourth separation unit 706 on a per frequency band basis and information indicating which one of the signals has an advanced phase, that is, phase polarity information, and encodes the phase polarity information. The method for detecting phase differences here may be any method, for example, a method of calculating the phase differences based on the representative values of real numbers or imaginary numbers in the Fourier series within the frequency band. The phase differences and the phase polarity information detected in this way are encoded by the third coding unit 708.

Here, note that the column (right-end) of the polarity information in FIG. 3. The polarity information is detected and encoded only for the lower eleven frequency bands. The aim of this is reducing the bit rate without deteriorating sound quality by utilizing the characteristic that auditory sense is very insensitive in the high frequency band to the phase polarity information.

In the case where the bit rate is low, no phase polarity information is encoded.

Lastly, the formatter 709 multiplies output signals from the first to third coding units so as to form a bitstream. However, any method may be used.

As described above, the audio encoder in this embodiment has: a first coding unit which codes a downmix signal obtained by downmixing two audio signals; a first transformation unit which transforms the first audio signal into a frequency domain signal; a second transformation unit which transforms the second audio signal into a frequency domain signal; a first separation which separates the frequency domain signal generated by the first transformation unit for the respective frequency bands; a second separation which separates the frequency domain signal generated by the first transformation unit in a way different from that of the first separation unit; a third separation which separates the frequency domain signal generated by the second transformation unit in the same way as that of the first separation unit; a fourth separation which separates the frequency domain signal generated by the second transformation unit in the same way as that of the second separation unit; a second coding unit which detects the gain ratios between the respective frequency bands of the frequency band signals separated by the first separation unit and the corresponding frequency bands of the frequency band signals separated by the second separation unit and codes the extracted gain ratios; a third coding unit which detects the phase differences between the respective frequency bands of the frequency band signals separated by the second separation unit and the corresponding frequency bands of the frequency band signals separated by the fourth separation units and the information indicating which phase of the two audio signals is ahead of the other and codes the phase differences and the information; and a formatter which multiplexes the output signal by the first to third coding units. With this structure, high compression is realized because a bitstream can be formed using a signal obtained by coding a one-channel downmix signal which was originally two-channel signals and a very small amount of encoded information for separating the signal into two-channel signals. Subsequently, since this bit stream is suitable for the audio decoder described in the first embodiment, it is reproduced into the original two-channel signals with high accuracy by the audio decoder.

FIG. 8 shows a codebook for encoding phase differences in this embodiment.

When a phase difference is indicated as θ, FIG. 8 is a table for indicating θ as cos θ encoding the value of cos θ. The left-most column in FIG. 8 shows threshold values in quantization. In other words, FIG. 8 is a table for indicating the value of cos θ as eleven-level quantized values. For example, cos θ values ranging from −1.000 to −0.969 are encoded as being in the same quantization level.

As clearly shown from FIG. 8, quantization accuracies for quantizing the cos θ values approximate to 0 (obtained by using phase differences of approximately 90 degrees) are roughly set compared with the cos θ values approximate to +1 (obtained by using phase differences of approximately 0 degrees) and −1 (obtained by using phase differences of approximately 180 degrees). These settings are performed considering the characteristic that the detection sensitivity for change in phase difference around 90 degrees is low, and the detection sensitivity for change in phase difference around 0 degree and 180 degrees is high.

In addition, setting such quantization thresholds naturally increases the number of occurrences of quantized values obtained by using a phase difference of 90 degrees. Thus, the use of variable-length codes, that is, Huffman codes improves the coding efficiency. In FIG. 8, the center column shows the lengths of Huffman codes at the respective quantization levels, and the right-most column shows the corresponding Huffman codes. As shown in the figure, the lengths of the codes corresponding to the quantized values obtained by using a phase difference of 90 degrees are very short.

This characteristic is further utilized. In the case of reducing the bit rate in encoding, as shown in FIG. 9, roughly setting the quantization accuracy for the frequency bands having a phase difference of 90 degrees is efficient for increasing the number of times when the quantized values of phase differences are the quantized values of approximately 90 degrees. A reason for this is that auditory sensitivity is low in the case of a phase difference of 90 degrees, and thus auditory sound quality is not deteriorated so much due to the quantization. Another reason for this is that the number of occurrences of the codes having a short code length increases, and thus the average bit rate is lowered.

FIG. 8 shows a mere example. The eleven-value quantization levels are not always used, and the Huffman code lengths are not always allocated as shown in the figure.

An audio decoder according to the present invention can be used for an audio reproducing apparatus, and in particular, it is suited for the application to music broadcasting services using low bit rates and receiving apparatuses used in the music broadcasting services.

The invention claimed is:

1. An audio decoder which decodes a bitstream and reproduces two audio signals, the bitstream including (i) first coded data indicating a downmix signal obtained by downmixing the two audio signals, (ii) second coded data indicating a gain ratio D between the two audio signals, and (iii) third coded data indicating a phase difference θ between the two audio signals, wherein the third coded data is a value of cos θ associated with the phase difference θ, wherein said audio decoder comprises:

a decoding unit operable to decode the first coded data into the downmix signal;

a transformation unit operable to transform the downmix signal into a frequency domain signal, the downmix signal being generated by said decoding unit;

a determination unit operable to determine, using the value of cos θ that is the third coded data, two phase rotators, a first phase rotator of the two phase rotators forming a phase rotation angle α, and a second phase rotator of the two phase rotators forming a phase rotation angle β, the phase rotation angle α and the phase rotation angle β being obtained by diagonally dividing a contained angle formed by two adjacent sides of a parallelogram where a length ratio between the two adjacent sides is equal to the gain ratio D indicated by the second coded data, and the contained angle being equal to the phase difference θ indicated by the third coded data;

a separation unit operable to separate the frequency domain signal into two separation signals using the two phase rotators and the gain ratio D indicated by the second coded data; and an inverse transformation unit operable to inversely transform the two separation signals, respectively, into time domain signals so as to reproduce the two audio signals, wherein said determination unit is operable to determine, as the two phase rotators, either two complex numbers $e^{-j\alpha}$ and $e^{j\beta}$ or two conjugate complex numbers $e^{j\alpha}$ and $e^{-j\beta}$ of the two complex numbers $e^{-j\alpha}$ and $e^{j\beta}$, wherein the bitstream further includes fourth coded data representing phase polarity information S indicating which of the two audio signals has a phase that is ahead of a phase of another of the two audio signals, wherein said separation unit is operable to generate the two separation signals by respectively multiplying, with the frequency domain signal transformed from the downmix signal by said transformation unit, either the two complex numbers or the two conjugate complex numbers associated with the phase polarity information S indicated as the fourth coded data, and wherein said inverse transformation unit accurately reproduces an advancement or a delay of the phase of each of the two audio signals by inversely transforming the two separation signals generated by multiplying, with the frequency domain signal transformed from the downmix signal by said transformation unit, either the two complex numbers or the two conjugate complex numbers associated with the phase polarity information S indicated as the fourth coded data.

2. The audio decoder according to claim 1, wherein said separation unit is operable to generate the two separation signals by respectively multiplying, with the frequency domain signal transformed from the downmix signal by said transformation unit, the two complex numbers determined as the two phase rotators by said determination unit.

3. The audio decoder according to claim 1, wherein said determination unit is operable to obtain the phase rotation angle α and the phase rotation angle β using the following equations:

$$\alpha=\arccos((1+D\cos\theta)/((1+D^2+2D\cos\theta)^{0.5}));\text{ and}$$

$$\beta=\arccos((D+\cos\theta)/((1+D^2+2D\cos\theta)^{0.5})),\text{ and}$$

wherein said determination unit is operable to determine the two phase rotators using the obtained α and β.

4. The audio decoder according to claim 1, wherein said determination unit is operable to obtain cos α associated with the phase rotation angle α and cos β associated with the phase rotation angle β, using the following equations:

$$\cos\alpha=(1+D\cos\theta)/((1+D^2+2D\cos\theta)^{0.5});\text{ and}$$

$$\cos\beta=(D+\cos\theta)/((1+D^2+2D\cos\theta)^{0.5}),\text{ and}$$

wherein said determination unit is operable to determine the two phase rotators using the obtained cos α and cos β.

5. The audio decoder according to claim 1, wherein the value of cos θ is calculated as a correlation value between the two audio signals.

6. The audio decoder according to claim 1, wherein said determination unit (a) includes a table which holds function values associated with phase differences, respectively, the function values being expressed using at least trigonometric functions of the phase differences, and (b) is operable to determine the two phase rotators with reference to a function value of the function values held in the table, the function value being associated with the phase difference θ indicated by the third coded data.

7. The audio decoder according to claim 6, wherein the table holds values of sin θ and cos θ, each of the values of sin θ and cos θ being associated with respective phase differences θ.

8. The audio decoder according to claim 7, wherein each of the values of sin θ and cos θ is associated with a same phase difference θ, in adjacent areas.

9. The audio decoder according to claim 6, wherein the table holds the following four function values associated with each of combinations, each of the combinations being made based on a specific gain ratio D and a specific phase difference θ:

$$W(D,\theta)=(1+D\cos\theta)/((1+D^2+2D\cos\theta)^{0.5});$$

$$X(D,\theta)=(D\sin\theta)/((1+D^2+2D\cos\theta)^{0.5});$$

$$Y(D,\theta)=(D+\cos\theta)4(1+D^2+2D\cos\theta)^{0.5});\text{ and}$$

$$Z(D,\theta)=\sin\theta/((1+D^2+2D\cos\theta)^{0.5}),\text{ and}$$

wherein said determination unit is operable to determine the two phase rotators with reference to the four function values held in the table, the four function values being associated with one combination of the combinations made of the gain ratio D indicated by the second coded data and the phase difference θ indicated by the third coded data.

10. The audio decoder according to claim 9, wherein the table holds, in adjacent areas, the four function values which are associated with the one combination of the combinations made of a same gain ratio D and a same phase difference θ.

11. The audio decoder according to claim 9, wherein the table holds corrected values obtained by further correcting the four function values according to the gain ratio D indicated by the second coded data.

12. The audio decoder according to claim 1, wherein said separation unit is operable to generate a reverberation signal by performing a process of adding reverberation to the frequency domain signal transformed from the downmix signal by said transformation unit, and operable to generate the two separation signals by mixing the frequency domain signal and the generated reverberation signal at a ratio determined according to the two phase rotators.

13. The audio decoder according to claim 1, wherein the bitstream respectively includes, for each respective frequency band of a plurality of frequency bands, the following: (i) second coded data indicating the gain ratio D, of the respective frequency band, between the two audio signals; and (ii) the third coded data indicating the phase difference θ, of the respective frequency band, between the two audio signals, wherein said transformation unit is operable to transform the downmix signal into a respective frequency domain signal for each respective frequency band of the plurality of frequency bands, wherein said determination unit is operable to determine, for each respective frequency band of the plurality of frequency bands, the two phase rotators, the first phase rotator of the two phase rotators forming the phase rotation angle α and the second phase rotator of the two phase rotators forming the phase rotation angle β, the phase rotation angle α and the phase rotation angle β being obtained by diagonally dividing the contained angle formed by the two adjacent sides of the parallelogram where: the length ratio between the two adjacent sides is equal to the gain ratio D indicated by the second coded data; and the contained angle is equal to the phase difference θ indicated by the third coded data, wherein said separation unit is operable to generate, for each respective frequency band of the plurality of frequency bands, two separation signals based on the respective frequency domain signal, using the two phase rotators and the gain ratio D determined for the respective frequency band, and wherein said inverse transformation unit is operable to inversely transform, for each respective frequency band of the plurality of frequency bands, the two separation signals into time domain signals, respectively, and operable to respectively reproduce the two audio signals for each respective frequency band of the plurality of frequency bands.

14. The audio decoder according to claim 13, wherein the bitstream includes, for at least one frequency band of the plurality of frequency bands, the fourth coded data representing the phase polarity information S indicating which of the two audio signals has a phase that is ahead of a phase of another of the two audio signals, wherein said determination unit is operable to determine, as the two phase rotators, either the two complex numbers $e^{-j\alpha}$ and $e^{j\beta}$ or the two conjugate complex numbers $e^{j\alpha}$ and $e^{-j\beta}$ of the two complex numbers $e^{-j\alpha}$ and $e^{j\beta}$, for each of the plurality of frequency bands, and wherein said separation unit is operable to generate the two separation signals in the following different ways, depending on a frequency band of the plurality of frequency bands: (i) by multiplying, with the frequency domain signal transformed from the downmix signal by said transformation unit, the two complex numbers, for a frequency band, of the plurality of frequency bands, for which the fourth coded data is not included in the bitstream; and (ii) by multiplexing, with the frequency domain signal transformed from the downmix signal by said transformation unit, either the two complex numbers or the two conjugate complex numbers associated with the phase polarity information S indicated by the fourth coded data, for the at least one frequency band, of the plurality of frequency bands, for which the fourth coded data is included in the bitstream.

15. The audio decoder according to claim 14, wherein the bitstream includes the fourth coded data only for frequency bands lower than a predetermined frequency.

16. An audio decoding method for decoding a bitstream and reproducing two audio signals, the bitstream including (i) first coded data indicating a downmix signal obtained by downmixing the two audio signals, (ii) second coded data indicating a gain ratio D between the two audio signals, and (iii) third coded data indicating a phase difference θ between the two audio signals, wherein the third coded data is a value of cos θ associated with the phase difference θ, wherein said audio decoding method comprises:

decoding the first coded data into the downmix signal;

transforming the downmix signal into a frequency domain signal, the downmix signal being generated by said decoding;

determining, using the value of cos θ that is the third coded data, two phase rotators, a first phase rotator of the two phase rotators forming a phase rotation angle α and a second phase rotator of the two phase rotators forming a phase rotation angle β, the phase rotation angle α and the phase rotation angle β being obtained by diagonally dividing a contained angle formed by two adjacent sides of a parallelogram where a length ratio between the two adjacent sides is equal to the gain ratio D indicated by the second coded data, and the contained angle being equal to the phase difference θ indicated by the third coded data;

separating the frequency domain signal into two separation signals using the two phase rotators and the gain ratio D indicated by the second coded data, a first separation signal of the two separation signals for indicating an angle α as a phase difference between the first separation signal and the downmix signal, and a second separation signal of the two separation signals for indicating an angle β as a phase difference between the second separation signal and the downmix signal; and inverse transforming the two separation signals, respectively, into time domain signals so as to reproduce the two audio signals, wherein said determining determines, as the two phase rotators, either two complex numbers $e^{-j\alpha}$ and $e^{j\beta}$ or two conjugate complex numbers $e^{j\alpha}$ and $e^{-j\beta}$ of the two complex numbers $e^{-j\alpha}$ and $e^{j\beta}$, wherein the bitstream further includes fourth coded data representing phase polarity information S indicating which of the two audio signals has a phase that is ahead of a phase of another of the two audio signals, wherein said separating generates the two separation signals by respectively multiplying, with the frequency domain signal transformed from the downmix signal by said transforming, either the two complex numbers or the two conjugate complex numbers associated with the phase polarity information S indicated as the fourth coded data, and wherein said inverse transforming accurately reproduces an advancement or a delay of the phase of each of the two audio signals by inversely transforming the two separation signals generated by multiplying, with the frequency domain signal transformed from the downmix signal by said transforming, either the two complex numbers or the two conjugate complex numbers associated with the phase polarity information S indicated as the fourth coded data.

17. A non-transitory computer-readable recording medium having a program recorded thereon, the program for performing audio decoding processing of decoding a bitstream and reproducing two audio signals, the bitstream including (i) first coded data indicating a downmix signal obtained by downmixing the two audio signals, (ii) second coded data indicating a gain ratio D between the two audio signals, and (iii) third coded data indicating a phase difference θ between the two audio signals, wherein the third coded data is a value of cos θ associated with the phase difference θ, wherein said program causes a computer to execute a method comprising:

decoding the first coded data into the downmix signal;

transforming the downmix signal into a frequency domain signal, the downmix signal being generated by said decoding;

determining, using the value of cos θ that is the third coded data, two phase rotators, a first phase rotator of the two phase rotators forming a phase rotation angle α, and a second phase rotator of the two phase rotators forming a phase rotation angle β, the phase rotation angle α and the phase rotation angle β being obtained by diagonally dividing a contained angle formed by two adjacent sides of a parallelogram where a length ratio between the two adjacent sides is equal to the gain ratio D indicated by the second coded data, and the contained angle being equal to the phase difference θ indicated by the third coded data;

separating the frequency domain signal into two separation signals using the two phase rotators and the gain ratio D indicated by the second coded data, a first separation signal of the two separation signals for indicating an angle α as a phase difference between the first separation signal and the downmix signal, and a second separation signal of the two separation signals for indicating an angle β as a phase difference between the second separation signal and the downmix signal; and inversely transforming the two separation signals, respectively, into time domain signals so as to reproduce the two audio signals, wherein said determining determines, as the two phase rotators, either two complex numbers $e^{-j\alpha}$ and $e^{j\beta}$ or two conjugate complex numbers $e^{j\alpha}$ and $e^{-j\beta}$ of the two complex numbers $e^{-j\alpha}$ and $e^{j\beta}$, wherein the bitstream further includes fourth coded data representing phase polarity information S indicating which of the two audio signals has a phase that is ahead of a phase of another of the two audio signals, wherein said separating generates the two separation signals by respectively multiplying, with the frequency domain signal transformed from the downmix signal by said transforming, either the two complex numbers or the two conjugate complex numbers associated with the phase polarity information S indicated as the fourth coded data, and wherein said inverse transforming accurately reproduces an advancement or a delay of the phase of each of the two audio signals by inversely transforming the two separation signals generated by multiplying, with the frequency domain signal transformed from the downmix signal by said transforming, either the two complex numbers or the two conjugate complex numbers associated with the phase polarity information S indicated as the fourth coded data.

* * * * *